United States Patent [19]

Combier et al.

[11] Patent Number: 4,921,098

[45] Date of Patent: May 1, 1990

[54] HANGER FOR DISPLAYING TEXTILE MATERIAL AND PACKAGE THEREOF

[75] Inventors: Charles M. Combier, Aiken; Archie E. Taylor, Jr.; Marc Paquette, both of Leesville, all of S.C.

[73] Assignee: J. B. Martin Company, Inc., Leesville, S.C.

[21] Appl. No.: 364,816

[22] Filed: Jun. 9, 1989

[51] Int. Cl.[5] ..... B65D 85/66

[52] U.S. Cl. ..... 206/408; 206/388; 223/91; 223/92; 211/45

[58] Field of Search ..... 206/408, 523, 388; 242/55; 223/91, 92; 211/45, 113; 248/174

[56] References Cited

U.S. PATENT DOCUMENTS

| | | | |
|---|---|---|---|
| 3,720,324 | 3/1973 | Berkowitz | 211/45 |
| 3,844,499 | 10/1974 | Berkowitz | 242/55 |
| 4,109,838 | 8/1978 | Dwek | 223/92 |
| 4,122,946 | 10/1978 | Holley | 206/523 |
| 4,234,088 | 11/1980 | Berkowitz | 206/408 |
| 4,416,401 | 11/1983 | King | 223/92 |
| 4,438,874 | 3/1984 | Zuckerman et al. | 223/91 |
| 4,778,088 | 10/1988 | Miller | 211/113 |
| 4,823,956 | 4/1989 | Belisle | 206/523 |

FOREIGN PATENT DOCUMENTS

| | | | |
|---|---|---|---|
| 81/02827 | 10/1981 | PCT Int'l Appl. | 223/91 |

*Primary Examiner*—David T. Fidei

*Attorney, Agent, or Firm*—Bell, Seltzer, Park & Gibson

[57] ABSTRACT

This invention relates to a hanger for receiving convolute wound textile material that is readily crushable and for shipping and thereafter displaying the wound textile material. The hanger has a generally planar skeletal frame having impaling pins at opposite ends of an upper portion thereof. The pins impale the fabric selvage at an upper portion of the wound textile fabric to suspendingly support the fabric on the hanger. The lower selvage of the textile fabric is secured by tie-down straps to a lower portion of the hanger frame. The hanger is suitable for supporting the textile material during shipment as when inserted into an appropriately sized carton. A pair of end plugs is provided at opposite ends of the hanger to ensure that the hanger and the fabric carried thereby do not shift around inside the carton and thereby cause the fabric to be wrinkled or crushed during handling and shipment.

16 Claims, 3 Drawing Sheets

10
20
21
21a
21b
21c
22
23
24
25
26
30
31
32
32a
33
34
40
41
42
43
45
45a
50
51
52
52a
53
54
54a
54b
55
55a
56
57
60
60a
60b
63
5
S

HANGER FOR DISPLAYING TEXTILE MATERIAL AND PACKAGE THEREOF

FIELD OF THE INVENTION

This invention relates to devices for shipping and subsequently displaying readily crushable textile fabric materials and in particular to a hanger for both shipping and thereafter displaying such materials.

BACKGROUND OF THE INVENTION

Most textile fabrics are conventionally shipped and handled in tightly wound rolls. Such fabrics are generally durable and may withstand the stretching and pulling from the winding process and compression of the roll. However, some textile materials such as woven velvet fabric have fibers which project outwardly from the plane of the fabric and which may be readily crushed. If the fabric is crushed it has a less appealing appearance and texture, and therefore has reduced saleability. Accordingly, great care must be taken during shipping and handling of such fabrics to prevent such permanent damage to the fabric.

It is current practice for shipping such fabrics to loosely wind the readily crushable fabric onto a shipping support which is provided in a box. For many purchasers, this practice has worked quite well and there is no reason to change. However, for fabric retailers, such as retailers selling small quantities of fabric to the consuming public, this practice has not been satisfactory. The problem is that the velvet must be transferred to a hanger more suited for displaying the velvet. Such display hangers are typically metal and consist of a horizontal bar with a medially positioned hanger hook and fabric impaling hooks at opposite ends of the horizontal bar. The velvet fabric is impaled on and suspended from the impaling hooks and the hanger is supported on a display rack with other fabric samples in a display like arrangement. The retailers, however, must manually transfer the fabric from the shipping support to the hangers which requires considerable time. It should be apparent that if a retailer intends to have a substantial variety of fabrics on display for sale, then there would be a large quantity of fabric in need of being transferred to a display hanger. The retailer, of course, would prefer to receive the fabric material on the display hanger, however the velvet fabric would be wrinkled and crushed if it were shipped on such a display hanger.

Berkowitz U.S. Pat. Nos. 3,720,324 and 3,844,499 both disclose an assembly for supporting textile fabric which is designed for shipment in a carton. The assembly comprises a hanger made from metal and being very similar in design to the conventional display hanger used by a retailer as described above. In addition, the assembly includes a generally vertical post and a base connected to the post for supporting the hanger in a spaced relationship from the base. Berkowitz, however, does not provide a fully satisfactory assembly for shipment. The post is held in place by the tension applied on the fabric hooked on the assembly. The assembly is unstable until the fabric is secured thereto. Moreover, if the post were to become displaced during shipment, the fabric would collapse to the bottom of the carton, thus becoming wrinkled and crushed under its own weight and the weight of the hanger. The post also provides no resistance to horizontal displacement of the fabric relative to the hanger or base.

Accordingly, it is an object of the present invention to provide a hanger for shipping and thereafter displaying a readily crushable textile material which avoids the disadvantages of the prior art as noted above.

It is a further object of the present invention to provide a package for shipping readily crushable textile material in which convolutely wound textile material is securely held in full width condition to prevent crushing or wrinkling thereof.

It is also an object of the present invention to provide a method of handling and packaging the textile material for securely shipping the material without wrinkling or crushing.

SUMMARY OF THE INVENTION

The above and other objects are achieved by the present invention by the provision of a hanger having a generally rectangular skeletal frame considerably longer than it is wide. The hanger includes hook means mounted for swivel movement on an upper medial portion of the frame so as to permit the frame to be rotated relative to the hook means for facilitating winding and unwinding of the textile material on and around the frame. Opposing pairs of fabric impaling means are connected to the frame adjacent opposite upper sides thereof and are positioned to extend outwardly at generally right angles to the plane of the frame. Each fabric impaling means includes a pair of upright pins offset from the frame, so that the frame bisects the respective pairs of pins. The frame further comprises strap engaging means on the lower portions of the frame adapted for receiving tie-down straps engaging lower regions of the wound textile material during shipment.

The invention further accomplishes the above objectives by providing a package including the fabric hanger with readily crushable fabric convolutely wound therearound. The fabric is suspendingly supported by the impaling means and lower selvage edges of the fabric are secured to the frame of the hanger by means penetrating the layers of lowermost fabric selvage. The convolutely wound fabric is placed into an elongate shipping carton with resilient plugs engaging the upper and lower portions of the frame for preventing shifting of the hanger and for spacing the frame of the hanger from inner surfaces of the carton.

The method of forming the package according to the present invention comprises providing a fabric hanger including a generally rectangular skeletal frame considerably longer than it is wide and opposing pairs of fabric impaling means connected to the frame at opposite upper sides thereof. The fabric is convolutely wound around the pairs of fabric impaling hooks while impaling the layers of the uppermost selvage of the fabric on the impaling hooks with the remainder of the fabric depending therefrom so that the opposing selvage is lowermost. The layers of the lowermost selvage of the fabric are secured to lower end portions of the hanger and the thus wound fabric is positioned in an elongate shipping carton. The shipping carton is provided with elongate resilient plugs each having a slot extending lengthwise for matingly receiving a respective end of the fabric hanger.

BRIEF DESCRIPTION OF THE DRAWINGS

Some of the features of the invention have been stated and others will appear as the description proceeds when taken in conjunction with the accompanying drawings in which.

DETAILED DESCRIPTION OF THE PREFERRED EMBODIMENTS

Figures 1, 2, 3, 4, 5:
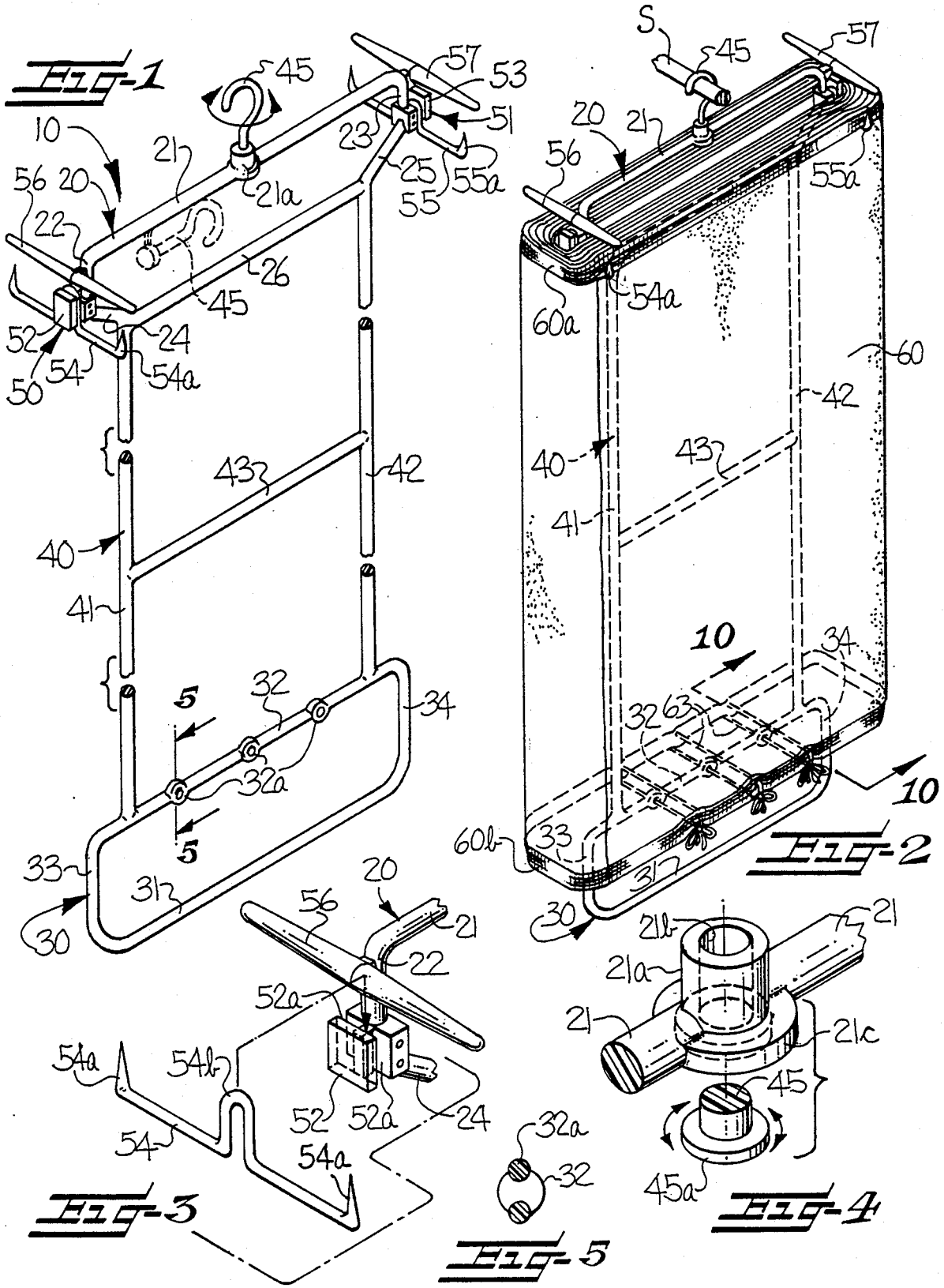
FIG. 1 is a partially fragmentary top perspective view of a hanger embodying the features of the present invention.
FIG. 2 is a partially fragmentary top perspective view of the hanger with a fabric convolutely wound thereabout.
FIG. 3 is an enlarged exploded fragmentary top perspective view of an impaling assembly at an upper side portion of the hanger.
FIG. 4 is an enlarged exploded fragmentary top perspective view illustrating suitable means for connecting a swivelling hook to a top medial portion of the hanger.
FIG. 5 is an enlarged sectional view through an eyelet at a lower portion of the hanger and being taken along line 5—5 in FIG. 1.
Figure 6:
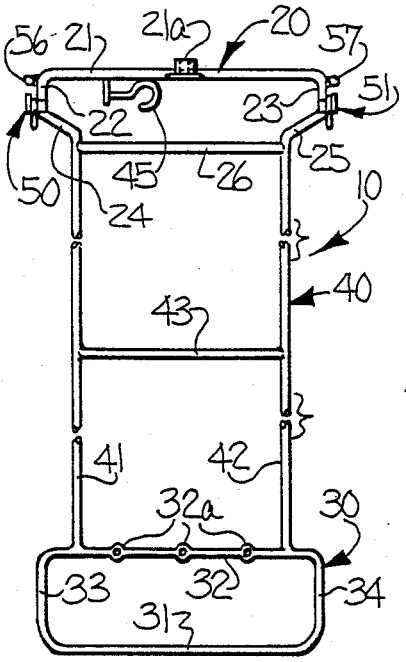
FIG. 6 is a fragmentary front elevation view of the hanger.
Figure 7:
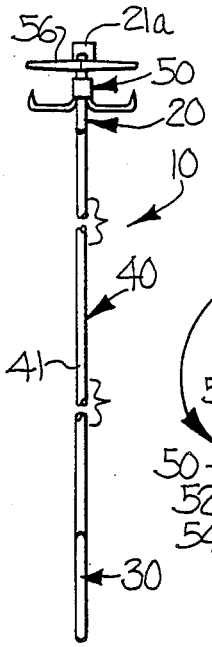
FIG. 7 is a fragmentary side elevation of the hanger.

Referring more particularly to the drawings, FIGS. 1–7 illustrate a preferred embodiment of a hanger generally indicated by the numeral 10, for shipping and thereafter displaying a readily crushable textile fabric, such as velvet fabric. The hanger 10 is essentially in the form of an elongate, generally rectangular, integrally molded skeletal frame of resilient plastic material. The frame is comprised of a plurality of interconnected bars molded together. Alternatively, the frame may be made of metal and the bars thereof secured together by welding or any other suitable means. The frame is best shown in FIGS. 1, 2, 6–9, 11 and 12 as comprising three portions, namely (1) an upper end frame portion 20; (2) a lower end frame portion 30; and (3) an intermediate body portion 40 extending between and connected to the upper and lower end frame portions 20 and 30.

The upper end frame portion 20 comprises an elongate generally horizontal top bar 21 extending widthwise of the hanger 10. At opposite ends of the top bar 21 are downwardly extending shoulder bars 22 and 23 which are relatively short compared to the length of top bar 21. Connector bars 24 and 25 extend inWardly and downwardly at an obtuse angle from the lower ends of the shoulder bars 22 and 23. An upper bracing or reinforcing bar 26 extends between and interconnects lower end portions of the inwardly extending connector bars 24 and 25 to form a closed loop structure of the bars 21–26. The upper end frame portion 20 is therefore a generally horizontally disposed elongate resilient polygonal frame arranged at the upper part of the hanger 10.

Figure 12:
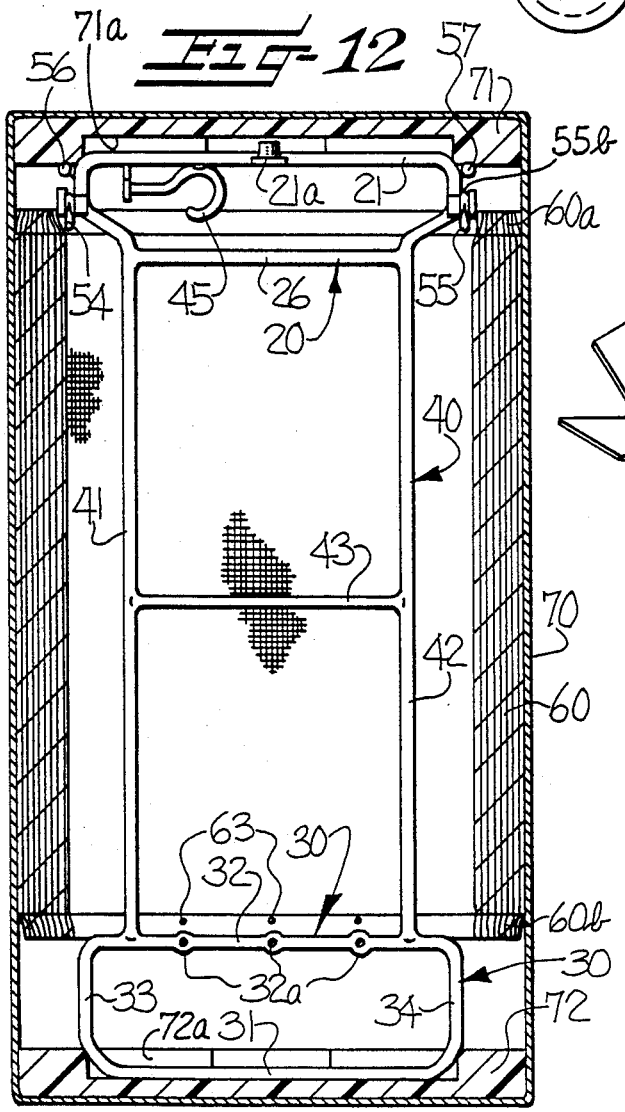
FIG. 12 is a front elevational view of the fully assembled package with the wound textile fabric in the carton and showing the layers of fabric, the stabilizing plugs and the carton in section.

The lower frame portion 30 forms a generally horizontally disposed, elongate, substantially rectangular resilient frame and comprises a generally horizontal bottom bar 31 and a substantially parallel lower bracing bar 32 spaced above bottom bar 31 (FIGS. 1, 2 and 12). The ends of the bottom bar 31 and lower bracing bar 32 are connected to the end portions of substantially vertical and relativelY short foot bars 33 and 34. As will be explained more below, the bottom corners of the lower portion 30 formed by the foot bars 33 and 34 and the bottom bar 31 are generally rounded.

The intermediate body portion 40 of the hanger 10 extends between and interconnects the upper and lower frame portions 20 and 30. The vertical extent or height of the intermediate body portion 40 is preferably about the same as or somewhat less than the width dimension of the fabric to be carried by the hanger 10. The intermediate body portion 40 comprises a pair of laterally spaced, elongate, generally vertical side bars 41 and 42 which are offset inwardly from the vertical shoulder and foot bars 22, 23, 33 and 34. Thus, the side bars 41 and 42 define recesses along opposite sides of the hanger 10. The intermediate body portion 40 further includes one or more transverse support bars 43 extending between and connected to the side bars 41 and 42 for imparting additional strength to the hanger 10.

The hanger 10 is adapted to be removably suspended from and rotated about a substantially vertical axis beneath an elevated hanger support S or S' (see FIGS. 2 and 8) suitable for accommodating a hanger hook generally the type usually provided on a conventional coat hanger. In this regard, it is desirable that the hanger 10 of the present invention be readily swivelly suspended at a manufacturer's location where a fabric to be shipped is wound about the hanger (see FIG. 8) for shipment in a carton to another or second location such as a retail store. More importantly, it is desirable that the hanger 10, with fabric wound thereon, be readily swivelly suspended by the receiving retailer for the purpose of displaying the fabric and unwinding desired lengths of the fabric from the hanger for sale to consumers.

For the convenience of the retailer, and so as to be readily available to the retailer, a hanger hook 45, is desireably molded integral with the top bar 21 of the hanger 10, and is shipped to the retailer with the hanger hook 45 positioned within the shipping carton 70 to be later described. During the winding of the fabric on the hanger 10 and subsequent shipment of the fabric package, the hanger hook 45 remains integral with the horizontal top bar 21 as shown in FIGS. 6, 8, 9 and 12. The hanger hook 45 is made from plastic, and is frangible at its juncture with top bar 21 and may thus be readily broken away from the top bar 21 by an operator. The thus removed hanger hook 45 then may be readily mounted in that position in which it is illustrated in FIGS. 1 and 2 in a manner to be later described.

Figure 8:
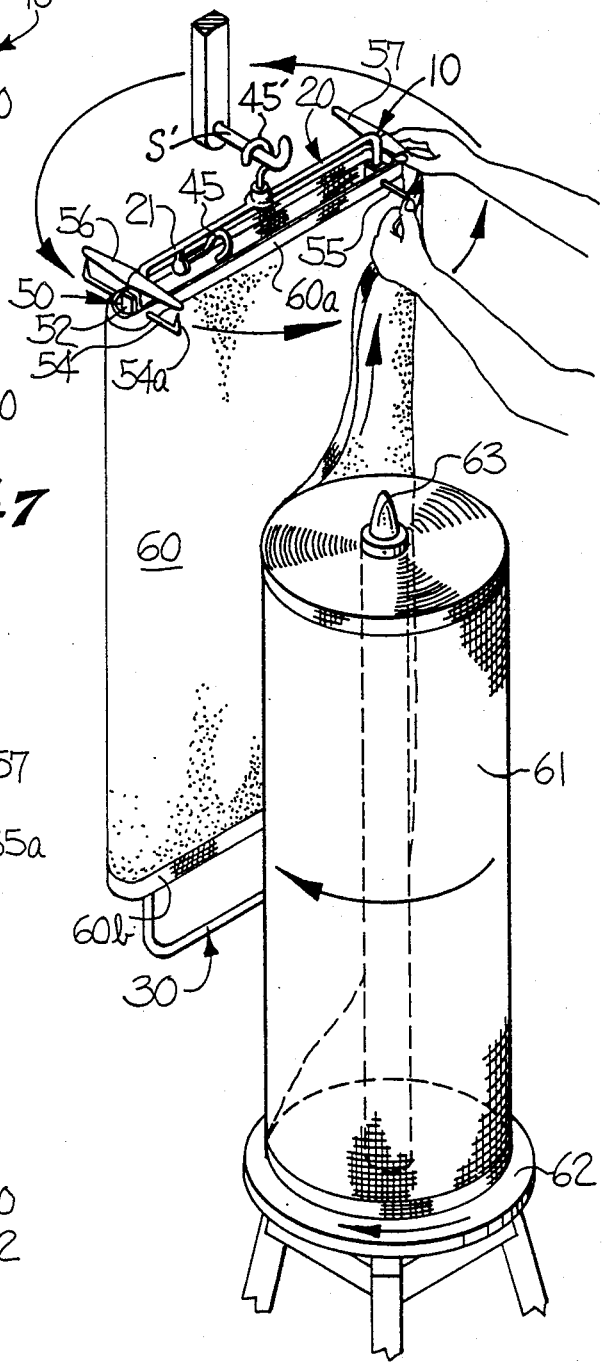
FIG. 8 is fragmentary top perspective view of the textile fabric being convolutely wound about the hanger.

In FIG. 8 it will be observed that a second or auxiliary hanger hook 45', which may be similar to hanger hook 45 is used by the manufacturer while winding fabric on the hanger 10. In such instance, the first mentioned hanger hook 45 remains in its condition integrally molded with the hanger top bar 21 and will also remain in such integral condition until it is broken awaY and separated from the top bar 21 at the retailer's location.

Once the retailer or other receiver of the shipped fabric package has broken the hanger hook 45 away from the top bar 21 the hanger 10, as indicated in FIGS. 1 and 2, the hanger hook 45 is swivelly connected to a sleeve 21*a* molded integral with a medial portion of the top bar 21 (FIGS. 1, 6, 7, 9 and 12).

As best illustrated in FIG. 4, the sleeve 21*a* is formed with a substantially vertical passage 21*b* therethrough, and the lower end of sleeve 21*a* has a disc or enlarged portion 21*c* coaxially aligned therewith and having a greater dimension or diameter than that of the sleeve 21*a*. The hanger hook 45 is arranged to be inserted upwardly and withdrawn downwardly through the vertical passage 21*b* in the sleeve 21*a*. In use a shoulder 45*a* at the lower end of the stem of the hanger hook 45 engages the sleeve 21*a*. The hanger hook 45, therefore, is freely rotatable relative to the hanger frame so as to allow the hanger to be rotated and to permit the fabric to be wound thereon and unwound therefrom as will be explained in greater detail below.

It is apparent that the vertical passage 21*b* (FIG. 4) in sleeve 21*a* is sufficiently larger than the cross-sectional configuration of the curved body of the hanger hook 45 to permit the user to readily pass the curved body of the hanger hook 45 through the sleeve 21*a*. By the same token, the shoulder 45*a* on the hook 45 should be of such size as to preclude its being passed through the passage 21*b* of the sleeve 21*a*. Depending upon which hanger hook 45 or 45' is being used, it is apparent that it may be readily positioned within and removed from sleeve 21*a*. For example, after fabric has been wound on hanger 10 as in FIG. 8, the auxiliary hanger hook 45, may be removed from sleeve 21*a* and stored by the manufacturer or shipper for later use in winding fabric on another hanger. As heretofore stated, the hanger hook 45 is used for swivelly supporting the hanger 10 and fabric wound thereon during subsequent displaying and unwinding of fabric from the hanger 10. The bottom of sleeve 21*a* may be recessed relative to the disc 21*c* such that when the shoulder 45*a* engages the sleeve, the shoulder 45*a* is hidden by the disc 21*c*.

The fabric is suspended from the hanger 10 by a pair of identical fabric impaling means 50 and 51 positioned at the opposite ends of the top bar 21 or more particularly along the shoulder bars 22 and 23. The fabric impaling means 50, as more particularly illustrated in FIG. 3, comprises a mounting block 52 which is preferably molded integrally with the frame adjacent the lower portion of shoulder bar 22. If so desired, the mounting block 52 may be separately made and mounted to the frame as by welding, adhesive, or other known means. The fabric impaling means 50 further includes a fabric hook 54 formed from a transversely extending bent rod forming back-to-back fabric hooks having upwardly extending impaling pins 54*a* at the opposite ends thereof and a medially positioned inverted U-shaped portion 54*b*. The fabric hook 54 is arranged transversely at right angles to the plane of the hanger 10 and is substantially bisected by the body of the hanger 10. The mounting block 52 (See FIG. 3) includes vertically spaced slots 52*a* for frictionally mounting the inverted U-shaped portion 54*b*.

The fabric impaling means 50 further includes a shielding safety bar 56 spaced above the pins 54*a*. The shielding safety bar 56 desirably extends transversely beyond the impaling pins 54*a* so as to partially block or shield the pins. Accordingly, an object such as one's hand moving down onto the hanger 10 near the pins 54*a* would be shielded by the safety bar 56. Also, the shielding safety bar 56 has a length approximately the same as the internal thickness of carton 70 to aid in stabilizing the hanger 10 within the carton 70.

Similar to the fabric impaling means 50, the impaling means 51 is mounted at the opposite end of the top bar 21 on the shoulder bar 23 (FIG. 1) and includes mounting block 53, a transversely extending fabric hook 55 and a safety bar 57.

Figure 10:
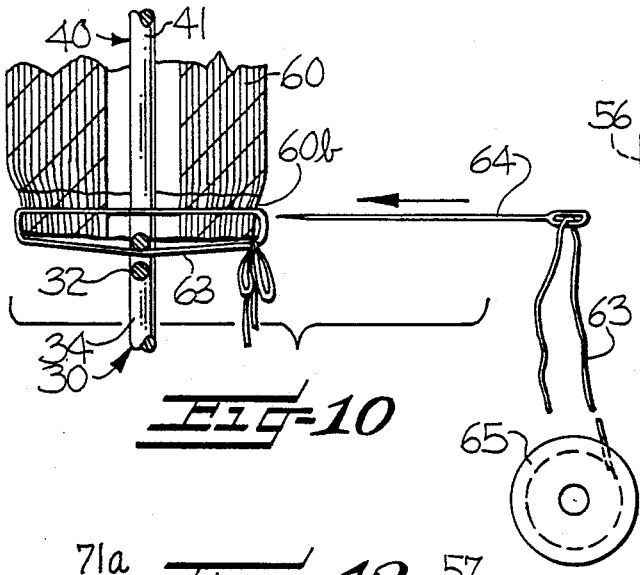
FIG. 10, taken substantially along line 10—10 in FIG. 2, is an enlarged fragmentary vertical sectional view of a lower portion of the hanger illustrating how a belt, strand or filamentary material may be inserted through the lower selvage portion of the fabric wound on the hanger.

The lower portion of the impaled and suspended fabric is secured to the hanger 10 by strap engaging means in the form of a plurality of eyelets 32*a* positioned along and integral with the lower bracing bar 32. As best illustrated in FIGS. 1, 5 and 10, three eyelets 32*a* are illustrated. The use of the eyelets 32*a* will be more particularly explained below in association with winding and securing the fabric onto the hanger 10.

In a preferred embodiment of the invention, the frame has an overall height of about four feet and a width of about one and a half feet. For wider fabrics the frame would be suitably longer. The frame is preferably injection molded of a suitable resilient plastic material with the various bars and components of the skeletal frame having a diameter in the range of $\frac{1}{8}''$ to $\frac{1}{2}''$ and preferably approximately $\frac{3}{8}''$. The fabric hooks 54, 55 are metal so as to present sharp ends 54*a* and 55*a*. The overall weight of the hanger is preferably less than 20 ounces so that the hanger is relatively inexpensive lending itself to being disposable after one use.

Referring noW to FIG. 2, the hanger 10 is illustrated with a textile fabric 60 convolutely wound about the hanger 10 and suspended therefrom. The textile fabric 60 has opposed side selvage portions 60*a* and 60*b* (FIGS. 2, 8, 9, 10 and 11), wherein selvage portion 60*a* is positioned uppermost on the hanger 10. The upper fabric selvage portion 60*a* is impaled on the fabric hooks 54 and 55 and the main body of the fabric 60 depends downwardly therefrom. As is more particularly illustrated in FIG. 8, the fabric may be delivered from a source such as an upright rotatable roll 61 supported by a stool 62 having a central upright shaft 63 for holding the roll of textile fabric 61 thereon.

The fabric 60 is pulled off the roll manually and impaled on the pairs of impaling pins 54*a* and 55*a*. This is done in a sequential fashion as the operator rotates the hanger 10 and the fabric is conVolutely wound about the hanger. It should be noted that the fabric should be loosely wound on the hanger to avoid crushing the underlayers of the fabric during shipment. To further reduce the risk of such crushing, the medial portion of the hanger frame is of reduced width and is offset inwardly from upper and lower portions of the frame. This provides a recess or more room for the fabric to hang within without being squeezed or crushed. After a desired length of fabric is convolutely wound about the hanger, the fabric covered hanger is prepared for shipping.

To prepare the fabric for shipment the lower end selvage 60*b* of the fabric 60 is tied down to the lower end portion of the hanger 10 by tie-down straps 63. The tie-down straps 63 may be in the form of string, wire or any other suitable material. The tie-down straps 63, as schematically illustrated in FIG. 10, are supplied from a spool 65 of string. Each strap formed from the string is inserted through the selvage 60*b* and back through one of the eyelets 32*a* as by means of a sewing needle 64. Thereafter, the thus formed tie-down straps 63 may be tied or knotted to insure that the fabric is maintained in its full width condition and to prevent the fabric from moving about during shipment. When it is desired to display the fabric, tiedown straps 63 are removed to allow the fabric to be unwound.

Figure 9:
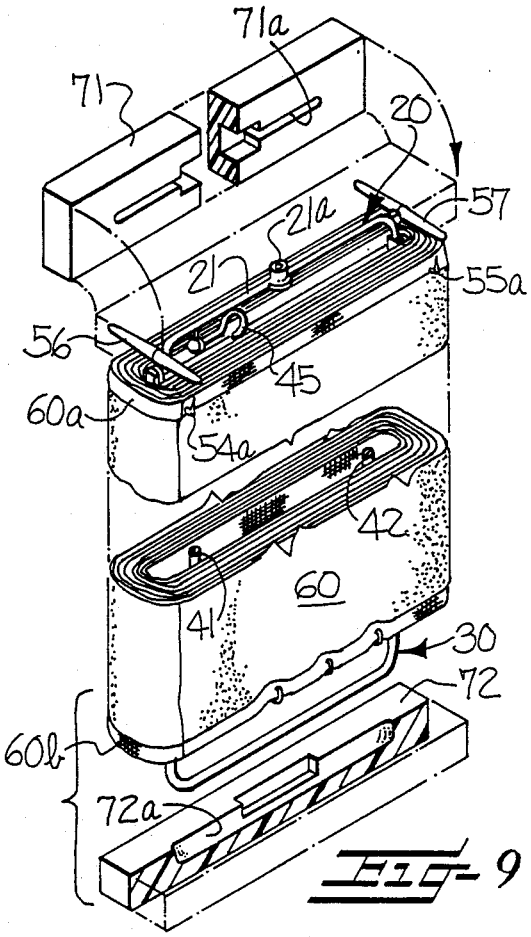
FIG. 9 is an exploded fragmentary top perspective view of the hanger with the fabric convolutely wound thereabout and with hanger stabilizing plugs aligned to fit over the upper and lower portions of the hanger when the hanger with fabric wound thereon is enclosed in a carton.
Figure 11:
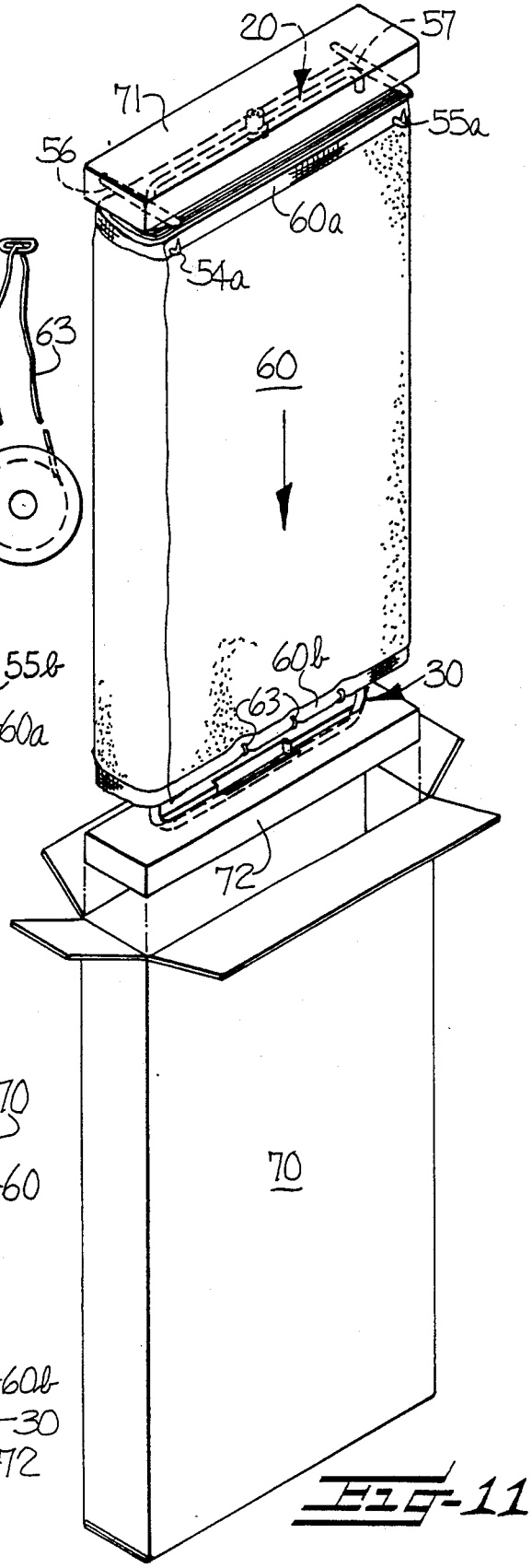
FIG. 11 is an exploded top perspective view of the textile fabric in the carton.

The textile fabric 60 is preferably shipped in a carton generally referred to by the numeral 70. However, considerable damage may be done to the textile fabric if it is allowed to shift or move around inside the carton 70. To prevent such movement, following removal of the hanger hook 45' from the hanger frame, resilient plugs 71 and 72 are provided to matingly receive the respective upper and lower end portions 20, 30 of the hanger lo and for substantially restricting movement of the frame within the carton 70. In particular, the resilient plugs 71 and 72, as illustrated in FIGS. 9, 11 and 12, may each be in the form of an elongate generally resilient rectangular block having an elongate medial recess or slot formed therein as respectively identified at 71*a* and 72*a*. As best seen in FIG. 12, the resilient plugs 71 and 72 have an overall length corresponding substantially to the inside width of the carton and an overall width corresponding substantially to the inner thickness of the carton. Accordingly the plugs do not shift within the carton and further prevent shifting of the hanger and fabric within the carton as well as spacing the frame of the hanger 10 from inner surfaces of the carton. Further, the dimensions of the resilient plugs relative to inner dimensions of the carton provide reinforcement for the carton 70 and more particularly reinforcing the upper and lower ends and corners of the carton to prevent crushing thereof. Since the plugs 71 and 72 are made of resilient material and the plugs are positioned between the ends of the frame and the carton the plugs further provide cushioning to absorb shock in the event the carton is dropped, etc. The resilient plugs 71 and 72 are preferably made of cardboard, foam or other relatively inexpensive lightweight material and may be formed identical to one another so as to be freely substituted one for the other.

The elongate slots or recesses 71*a* and 72*a* have enlarged central portions particularly to accommodate the wide hanger disc 21*c* at the upper end of the hanger 10 . To further aid in stabilizing the hanger 10 with wound fabric within the carton 70, the safety bars 56 and 57 for the impaling pins 54*a*, 55*a* preferably have a length generally corresponding to the internal thickness of the carton 70. Therefore the ends of the safety bars 56 and 57 will engage the sidewalls of the carton 70 and further prevent lateral shifting of the upper end of the hanger 10 within the carton.

The final step prior to shipping is to insert the hanger 10 with fabric 60 wound thereon together with the plugs 71 and 72 into the carton 70 as illustrated in FIG. 11. The fabric is thereby protected by an inexpensive and simple arrangement for shipment. Upon receipt by the retailer or merchant, the textile fabric wound about the hanger is simply removed from the carton 70. The carton 70 and the plugs 71 and 72 may be discarded or put to another use. The hook 45 is removed from its stowed position and inserted through the cylindrical sleeve 21*a* in the manner heretofore described. The hanger may be suspended from any type of support or rack for display or storage. The tie-down straps 63 securing the lower end selvage 60*b* then may be removed to allow the lower end of the fabric 60 to hang freely. The hanger 10 supporting the fabric is thus adapted to display the textile fabric on a display rack with other fabric samples if desired.

As a further precaution against crushing and wrinkling the outer layers of the fabric during formation of the shipping package and during shipment thereof, it is preferred that, when the desired amount of fabric has been wound on the hanger as in FIGS. 8–12, the total thickness of the several layers of fabric wound about the hanger should be slightly less than the length of the resilient plugs 71, 72 (FIGS. 9, 11 and 12) and less than the internal thickness of the carton 70 between the opposite substantially rectangular sidewalls thereof. Thus, the outer side layers of the fabric 60 wound about hanger 10 will be spaced inwardly from the sidewalls of the carton.

The fabric will thus be delivered to a customer without being crushed or wrinkled and little time and effort are required from the time of receipt to display the fabric for sale. The hanger also functions quite similar to conventional hangers so it would not appear to be different from other hangers in a store displaying other textile fabric.

Accordingly there has been disclosed a hanger for receiving and displaying wound textile material such as woven velvet fabric. The hanger comprises a generally rectangular frame considerably longer than it is wide. A pair of opposed fabric impaling means are connected to the frame at opposite upper sides thereof for impaling upper selvages of the textile material as the textile material is convolutely wound on and around the hanger. The hanger and wound textile material thereon may be inserted into a carton for shipment so that during shipping and handling the textile material is not wrinkled or crushed.

In the drawings and specification, there has been set forth preferred embodiments of the invention, and although specific terms are employed, they are used in a generic and descriptive sense only and not for purposes of limitation.

That which is claimed is:

1. A hanger for shipping and thereafter displaying a readily crushable textile material such as woven velvet fabric adapted to be convolutely wound on and around the hanger, said hanger comprising a single, unitary one piece generally rectangular skeletal frame of interconnected bars, said frame being considerably longer than it is wide and adapted to be encircled by fabric wound around medial portions thereof, hanger hook means mounted for swivel movement on an upper medial portion of said frame so as to permit said frame to be rotated about a substantially vertical axis relative to said hanger hook means for facilitating winding and unwinding textile material on and around said frame, and opposing pairs of fabric impaling means connected to said frame adjacent opposite upper sides of the frame and positioned to extend outwardly at generally right angles to the plane of said frame, each impaling means including a pair of upright pins offset from said frame so that said frame bisects the respective pairs of pins.

2. A hanger according to claim 1 wherein said frame has an intermediate body portion offset inwardly relative to upper and lower portions of said frame and offset inwardly relative to said fabric impaling means so as to provide space for textile material to hang freely from said fabric impaling means and to avoid compacting the textile material onto peripheral portions of said frame.

3. A hanger according to claim 1 wherein said skeletal frame is an integral unit of molded plastic.

4. A hanger according to claim 1, 2 or 3 wherein said fabric impaling means and said upright pins thereof are formed of metal, and wherein said pins have sharp upper ends.

5. A hanger according to claim 1 including strap engaging means on lower portions of said frame adapted for receiving tie-down straps engaging lower portions of wound textile material during shipment.

6. A hanger according to claim 1 wherein said frame has an overall height of at least about four feet and a width of about one and one-half feet.

7. A hanger according to claim 1 wherein said skeletal frame comprises generally cylindrical bars integrally molded of plastic material, and wherein the cross sectional diameter of said cylindrical bars is $\frac{1}{8}$ to $\frac{1}{2}$ an inch to provide a relatively inexpensive hanger which may be discarded after use.

8. A hanger for shipping and thereafter displaying a readily crushable textile material such as woven velvet fabric adapted to be convolutely wound on and around the hanger, said hanger comprising a single, unitary one piece generally planar generally rectangular unitary skeletal frame of interconnected bars, said frame being considerably longer than it is wide and adapted to be encircled by fabric wound around medial portions thereof, hanger hook means mounted for swivel movement on and extending upwardly from a medial upper portion of said frame so as to permit said hanger hook means to engage a support and be suspended therefrom to permit said frame to be rotated relative to said hook means for facilitating winding and unwinding of the textile material on and around said frame, opposing pairs of fabric impaling means connected to said frame at opposite sides of upper portions and positioned to extend outwardly at generally right angles to the plane of the frame, each fabric impaling means including back-to-back fabric impaling hooks extending from said frame so that said frame bisects said respective pair of said fabric impaling hooks, strap engaging means on lower portions of said frame adapted for receiving tie-down straps engaging lower regions of wound textile material during shipment, and wherein medial portions of said frame are offset inwardly relative to upper and lower portions of said frame and offset inwardly relative to said fabric impaling hooks so as to provide space for the textile material to hang freely from said fabric impaling books so as to avoid compacting the fabric onto peripheral portions of said frame.

9. The combination of a readily crushable textile material such as woven velvet fabric having opposing selvages extending along opposite sides of the fabric, and a hanger for receiving a convolute winding of said textile material for shipping and thereafter displaying said textile material, said hanger comprising a single, unitary one piece generally rectangular skeletal frame of interconnected bars, said frame being considerably longer than it is wide and adapted to be encircled by fabric wound around medial portions thereof, hanger hook means loosely mounted for swivel movement on an upper medial portion of said frame so as to permit said frame to be rotated about a substantially vertical axis relative to said hanger hook means for facilitating winding and unwinding said textile material on and around said frame, opposing pairs of fabric impaling means connected to said frame adjacent opposite upper sides of the frame and positioned to extend outwardly at generally right angles to the plane of said frame, and said textile material being convolutely wound around said pairs of fabric impaling means with layers of the uppermost selvage of said textile material being impaled on said impaling means and the remainder of said textile fabric depending downwardly therefrom with the opposing selvage being lowermost.

10. The combination according to claim 9 including means penetrating the layers of the lowermost selvage of the wound textile material and secured to lower portions of said hanger to maintain the lowermost selvage of the textile material adjacent thereto.

11. The combination according to claim 9, wherein said frame has an intermediate body portion offset inwardly relative to upper and lower portions of said frame, and offset inwardly relative to said fabric impaling means so as to provide space for said convolute wound textile material to hang freely from said fabric impaling means and to avoid compacting said textile material onto peripheral portions of said frame.

12. A package including a hanger, a convolute winding of a readily crushable textile material such as woven velvet fabric having opposing selvages extending along opposite sides of the fabric, and a shipping carton containing said hanger and wound textile material thereon, said hanger comprising a single, unitary one piece generally rectangular skeletal frame of interconnected bars, said frame being considerably longer than it is wide, and opposing pairs of fabric impaling means carried at opposite upper sides of said frame, said textile material being convolutely wound around said pairs of impaling means and encircling medial portions of said frame with the uppermost selvage of the layers of wound textile material being impaled on said impaling means and the remainder of said textile material depending downwardly therefrom with the opposing selvage being lowermost, means penetrating the lowermost selvage of the layers of textile material and being secured to lower potions of said hanger to maintain the lowermost fabric selvage adjacent thereto, and means within said carton for receiving and engaging upper and lower portions of said frame for preventing shifting of said hanger and said fabric wound thereon and for spacing said frame from inner surfaces of said carton to avoid compacting said wound textile material against inner surfaces of said carton.

13. The package according to claim 12 wherein medial portions of said skeletal frame are offset inwardly relative to upper and lower portions of said frame and relative to said fabric impaling means so as to provide a space for said textile material to hang freely from said fabric impaling means and to avoid compacting said textile material onto peripheral portions of said frame.

14. The package according to claim 12 wherein said skeletal frame is an integral unit of molded plastic.

15. The package according to claim 12, 13 or 14 wherein each of said fabric impaling means includes a pair of upright pins offset from said frame so that said frame bisects the respective pairs of pins an wherein said fabric impaling means are formed of metal, and further wherein said upright pins have sharp upper ends.

16. The package according to claim 12 wherein said means within said carton for preventing shifting of said hanger and for spacing said frame from inner surfaces of said carton comprises upper and lower plug means formed of resilient material, each plug means extending substantially entirely across the internal width of said carton and respectively terminating adjacent opposing corners of said carton, and wherein said plug means further serves to absorb shock and reinforce the corners of said carton to prevent crushing of said carton and said textile material therein.

* * * * *